US006120980A

United States Patent [19]

Ii et al.

[11] Patent Number: 6,120,980

[45] Date of Patent: Sep. 19, 2000

[54] SILVER HALIDE EMULSION AND SILVER HALIDE COLOR PHOTOGRAPHIC MATERIAL BY USE THEREOF

[75] Inventors: Hiromoto Ii; Rieko Ren; Sadayasu Ishikawa, all of Hino, Japan

[73] Assignee: Konica Corporation, Japan

[21] Appl. No.: 09/169,755

[22] Filed: Oct. 9, 1998

[30] Foreign Application Priority Data

Oct. 15, 1997 [JP] Japan ..... 9-281955

[51] Int. Cl.[7] ..... G03C 1/035

[52] U.S. Cl. ..... 430/541; 430/567

[58] Field of Search ..... 430/567, 541

[56] References Cited

U.S. PATENT DOCUMENTS

| | | | |
|---|---|---|---|
| 5,068,173 | 11/1991 | Takehara et al. | 430/567 |
| 5,492,800 | 2/1996 | Yamagami | 430/567 |
| 5,550,014 | 8/1996 | Maruyama et al. | 430/567 |
| 5,587,280 | 12/1996 | Ikeda, et al. | 430/567 |
| 5,702,878 | 12/1997 | Maruyama | 430/567 |
| 5,723,278 | 3/1998 | Jagannathan et al. | 430/567 |
| 5,807,663 | 9/1998 | Funakubo et al. | 430/567 |

FOREIGN PATENT DOCUMENTS

| | | | |
|---|---|---|---|
| 8-62754 | 3/1996 | Japan | G03C 1/035 |
| 8-190164 | 7/1996 | Japan | G03C 1/035 |

OTHER PUBLICATIONS

European Search Report EP 98 30 8434 Abstract XP–002092330/Derwent (1 page).

*Primary Examiner*—Mark F. Huff

*Attorney, Agent, or Firm*—Jordan B. Bierman; Bierman, Muserlian and Lucas

[57] ABSTRACT

A silver halide emulsion is disclosed, comprising silver halide grains having a variation coefficient of a grain diameter of 20% or less, at least 50% of total grain projected area being accounted for by tabular silver halide grains having an aspect ratio of 2 or more, said tabular grains each having 10 or more dislocation lines per grain in the peripheral region of the grain and having a variation coefficient of dislocation line length of 20% or less. A color photographic material by use of the emulsion is also disclosed.

6 Claims, No Drawings

SILVER HALIDE EMULSION AND SILVER HALIDE COLOR PHOTOGRAPHIC MATERIAL BY USE THEREOF

FIELD OF THE INVENTION

The present invention relates to a silver halide photographic emulsion, and in particular to a multi-layer silver halide light sensitive color negative photographic material which is superior in sensitivity and graininess ratio, pressure resistance and high intensity reciprocity law failure characteristics.

PRIOR ART

Recently, along with the popularity of compact cameras, single-lens reflex cameras and lens-fitted cameras is desired development of a silver halide light sensitive photographic material (hereinafter, also referred to as a photographic material) having high sensitivity and superior image quality. Accordingly, demand for improved performance of silver halide photographic emulsions has become stronger, and a high level demand for photographic performance such as enhanced sensitivity, superior graininess and sharpness have been raised.

In response to the demands, U.S. Pat. Nos. 4,434,226, 4,439,520, 4,414,310, 4,433,048, 4,414,306 and 4,459,353 disclose a technique of using tabular silver halide grains (hereinafter, also simply denoted as tabular grains), thereby leading to advantages, such as enhancement of sensitivity, including enhancement of spectral sensitization efficiency with a sensitizing dye, an improvement of sensitivity/graininess, enhanced sharpness due to the specific optical property of tabular grains and enhanced covering power. However, these are still insufficient response to recent high level demands and still further enhanced performance is desired.

In connection with the trend in enhancement of sensitivity and image quality, the desire for enhanced pressure characteristics of a silver halide photographic material has also increased. Attempts to improve pressure characteristics by various means have been made, and the view that techniques of enhancing stress resistance of silver halide grains is more effective and preferable in practical use rather than technique of using additives such as a plasticizer, is now accepted. In response to such desire, emulsions comprised of core/shell type silver halide grains containing a high iodide silver iodobromide layer have been widely studied. Specifically, a silver iodobromide emulsion comprised of core/shell type grains having an internal phase containing 10 mol % or more iodide has been noted as an emulsion for use in color negative films.

U.S. Pat. No. 4,956,269 discloses a technique of introducing dislocation lines into tabular silver halide grains to enhance the sensitivity of a silver halide emulsion. It is generally known that application of pressure to silver halide grains results in fog formation or desensitization, and dislocation lines-introduced grains exhibit the problem that when subjected to pressure, marked desensitization occurs. JP-A 3-189642 (herein, the term, JP-A means an unexamined published Japanese Patent Application) discloses a monodispersed silver halide emulsion which is accounted for by tabular grains having an aspect ratio of 2 or more and containing 10 or more dislocation lines in fringe portions of the grain. However, such a technique did not improve marked pressure desensitization caused by introduction of dislocation lines.

JP-A 59-99433, 60-35726 and 60-147727, for example, disclose a technique of improving pressure characteristics with core/shell type grains. JP-A 63-220238 and 1-201649 disclose a technique of improving graininess, pressure characteristics and exposure intensity dependence as well as sensitivity. JP-A 6-235988 discloses a technique of enhancing pressure resistance by the use of multiple structure type monodispersed tabular grains having a high iodide intermediate shell. JP-A 8-62754 discloses a technique in which the position for introducing dislocation lines is limited based on the added amount of silver; and JP-A 8-95181 discloses a technique in which the ratio of the average length of the dislocation lines to the grain diameter is limited to achieve enhancement of sensitivity.

JP-A 3-15040 discloses an iridium ion containing grain emulsion in which the iridium ion is not present on the grain surface and a preparation method thereof. JP-A 6-175251 discloses in-plane epitaxy type grains which has been doped with iridium, thereby improving reciprocity law failure characteristics as well as sensitivity at 1/100 sec. exposure. JP-A 7-104406 discloses a technique in which fine silver halide grains are added concurrently with an iridium compound to improve reciprocity law failure characteristics.

However, these techniques are insufficient in satisfying the current high level demands, such as a silver halide emulsion with high sensitivity, superior graininess, and improved pressure resistance and high intensity reciprocity law failure.

PROBLEM TO BE SOLVED

In view of the foregoing, an object of the present invention is to provide a silver halide emulsion superior in sensitivity-graininess ratio and improved in pressure characteristics and high intensity reciprocity law failure and a silver halide light sensitive photographic material by use thereof.

MEANS FOR SOLVING THE PROBLEM

The above object of the present invention can be accomplished by:

a silver halide emulsion containing silver halide grains, at least 50% of the total grain projected area being accounted for by tabular silver halide grains having an aspect ratio of 2 or more and further having a variation coefficient of grain diameter of 20% or less, the tabular grains each having 10 or more dislocation lines in the peripheral region of the grain, and a variation coefficient of a dislocation line length being 20% or less; the number of dislocation lines in the peripheral region being 30 or more per grain; and a silver halide light sensitive color photographic material comprising a support having thereon a silver halide emulsion layer containing the silver halide emulsion described above.

The present invention will be described further in detail.

Silver halide grains contained in the silver halide emulsion of the invention are tabular grains. The tabular grains are crystallographically classified as a twinned crystal.

The twinned crystal is a silver halide crystal having one or more twin planes within the grain. Classification of the twinned crystal form is detailed in Klein & Moisar, *Photographishe Korrespondenz,* Vol.99, p.100, and ibid Vol.100, p.57.

The tabular grains according to the invention are preferably ones having two or more twin planes parallel to the major faces. The twin planes can be observed with a transmission electron microscope, for example, according to the following manner. A coating sample is prepared by coating a silver halide emulsion on a support so that the major faces of tabular silver halide grains are oriented substantially parallel to the support. The sample is cut using a diamond cutter to obtain an approximately. 0.1 μm thick slice. The twin plane can then be observed with a transmission electron microscope.

The average spacing between twin planes can be determined according to the following manner. Thus, 1,000 tabular grains exhibiting a cross-section perpendicular to the major faces are selected through transmission electron microscopic observation of the slice and the shortest twin plane spacing of each grain is measured to obtain an arithmetic average thereof. The average twin plane spacing is preferably 0.01 to 0.05 μm, and more preferably 0.013 to 0.025 μm. The twin plane spacing can be controlled by selecting an optimal combination of parameters affecting supersaturation at nucleation, such as the gelatin concentration, the kind of gelatin, the temperature, the iodide ion concentration, pBr, pH, the ion supplying rate and the stirring rate. Details of the supersaturation parameter can be referred to, for example, in JP-A 63-92924 and 1-213637.

The average thickness of the tabular grains can be determined by similarly measuring the thickness of each grain through transmission electronmicroscopic observation of slices and arithmetically averaging the measured thickness. The average thickness of the tabular grains according to the invention is preferably 0.05 to 1.5 μm, and more preferably 0.07 to 0.50 μm.

The grain size of the tabular grains according to the invention, which is represented in terms of an equivalent circle diameter of the projected area of the silver halide grain (i.e., the diameter of a circle having an area equivalent to the projected area of the grain), is preferably 0.1 to 5.0 μm, and more preferably 0.2 to 2.5 μm.

The tabular grains according to the invention are those having an aspect ratio (or a ratio of grain diameter to grain thickness) of 2 or more and accounting for at least 50% of the total grain projected area, preferably are those having a 5 or more aspect ratio and acounting for at least 50% of the total grain projected area, more preferably are those having a 7 or more aspect ratio and accounting for at least 60% of the total grain projected area, and still more preferably are those having a 9 or more aspect ratio and accounting for at least 70% of the total grain projected area.

The grain diameter can be determined viewing silver halide grains at a factor of 10,000 to 70,000 with an electron microscope and measuring the diameter or projected area, in which at least 1,000 randomly selected grains, are subjected to measurement. The average grain diameter (r) is defined as ri when the product of the frequency (ni) of grain with a diameter (ri) and $ri^3$ (i.e., $ni \times ri^3$) is maximal (with the significant figure being three, and the last digit being rounded off).

The silver halide emulsion according to the invention is preferably comprised of monodispersed silver halide grains. The monodispersed emulsion has preferably 20% or less, and more preferably 16% or less of the grain diameter distribution width (or a variation coefficient of grain diameter), as defined below:

(standard deviation of grain diameter/average grain diameter)×100 [%]

where the average diameter and the standard deviation are determined from the diameter (ri) defined above.

The tabular grains according to the invention may be comprised of a core and a shell covering the core. The shell may be formed of one or more layers. In cases where the tabular grains are core/shell type grains as described above, the halide composition of the core and shell can optionally be selected. The core preferably accounts for 1 to 60%, based on the total silver amount, and more preferably 4 to 40%. In cases where the iodide content of the core is different from that of the shell, the iodide content difference between the core and the shell is preferably one having a sharp boundary. Grains having an intermediate layer between the core and shell are also preferred. In cases where the silver halide emulsion is comprised of core/shell type tabular grains having the intermediate layer described above, the intermediate layer preferably accounts for 0.1 to 20%, and more preferably 0.5 to 10% by volume of the grain. With respect to the difference in the iodide content between the intermediate layer and shell, the iodide content of the intermediate layer is preferably at least 2 mol % higher than that of the shell. The average overall iodide content of the tabular grains of the invention is preferably not more than 10 mol %, more preferably not more than 7 mol %, and still more preferably not more than 4 mol %.

The silver halide emulsion according to the invention preferably comprises mainly silver iodobromide, and may further comprise other halide, such as chloride. The iodide distribution within the core/shell type silver halide grain can be detected by various physical measurements, such as luminescent measurement at low temperatures and X-ray diffractometry, as described in Abstracts of Annual Meeting in 1981 of the Society of Photographic Science and Technology of Japan.

Means for forming the tabular grains according to the invention include a variety of methods known in the art. Thus, single jet addition, controlled double jet addition and controlled triple jet addition can be employed indivisually or in combination. To obtain highly monodispersed grains, it is important to control the pAg in the grain forming liquid phase, so as to fit the growth rate of silver halide grains. The pAg is to be in the range of 7.0 to 11.5, preferably 7.5 to 11.0, and more preferably 8.0 to 10.5. The flow rate can be selected by refering to JP-A 54-48521 and 58-49938.

A silver halide solvent known in the art such as ammonia, thioethers and thiourea may be employed in forming the tabular grains.

The tabular grains according to the invention may be grains forming latent images mainly on the grain surface or ones forming latent images mainly in the grain interior.

The tabular grains are prepared in the presence of a dispersing medium, i.e., in an aqueous solution containing a dispersing medium. The aqueous solution containing a dispersing medium is an aqueous solution in which a protective colloid is formed with gelatin or other compounds capable of forming a hydrophilic colloid (or materials capable forming a binder), and preferably an aqueous solution containing a colloidal protective gelatin.

Gelatins used as a protective colloid include alkali-processed gelatin and acid processed gelatin. Preparation of the gelatin is detailed in A. Veis, "The Macromolecular Chemistry of Gelatin", Academic Press (1964). Examples of hydrophilic colloids usable as a protective colloid other than gelatin include gelatin derivatives; graft polymers of gelatin and other polymers; proteins such as albumin and casein; cellulose derivatives such as hydroxyethylcellulose, carboxymethylcellulose and cellulose sulfuric acid ester; succharide derivatives such as sodium alginate and starch derivatives; and synthetic hydrophilic polymeric materials such as monopolymers or copolymers of polyvinyl alcohol, polyvinyl alcohol partial acetal, poly-N-vinyl pyrrolidone, polyacrylic acid, polymethacrylic acid, polyacryl amide, polyvinyl imidazole, and polyvinyl pyrazole. There is preferably employed gelatin having a jelly strength of at least 200, as defined in the PAGI method.

The tabular grains according to the invention can contain a metal element in the interior or exterior of the grain by adding at least one selected from a cadmium salt, a zinc salt, a thallium salt, an iron salt, a rhodium salt, an iridium salt, an indium salt and their complex salts the stage of nucleation and/or grain growth.

After completing the grain growth, the tabular grain emulsion of the invention can be desalted to remove unnecessary soluble salts. The emulsion can also be desalted during grain growth, as described in JP-A 60-138538. Desalting can be conducted according to the method described in Research Disclosure (hereinafter, also denoted as RD) 17643, Section II. More specifically, to remove soluble salts from the emulsion after forming precipitates or completing physical ripening are preferably employed the noodle washing method by gelling gelatin and the flocculation method using inorganic salts, anionic surfactants (e.g., polystylenesulfonate) or gelatin derivatives (e.g., acylated gelatin, carbamoyl-modified gelatin).

The average silver iodide content of a silver halide grain group can be determined by the EPMA (or Electron Probe Micro Analyzer) method. Thus, a sample which is prepared by dispersing silver halide grains, which are not in contact with each other, is exposed to electron beams while cooled with liquid nitrogen to not higher than −100° C. Characteristic X-ray intensities of silver and iodine which are radiated from individual grains are measured to determine the silver iodide content of each grain. At least 50 grains are subjected to measurement and their average value is determined.

In the tabular grains according to the invention, distribution of the iodide content is preferably uniform among grains. When the iodide content distribution among grains is determined, the relative standard deviation thereof is preferably 30% or less, and more preferably 20% or less.

Halide composition of the tabular grain surface can be determined by the XPS (X-ray Photoelectron Spectroscopy) method. In the invention, the grain surface of the tabular grains is referred to as the outermost layer including the outermost surface, to a depth of 50 Å from the outermost surface.

The XPS method is known as a technique for measuring the iodide content of the surface of silver halide grains, as disclosed in JP-A 2-24188. When measured at room temperature, however, X-ray irradiation destroys a sample so that the iodide content of the outermost surface can not be accurately determined. However, the inventors of the present invention succeeded in accurately determining the iodide content of the surface by cooling the sample to a temperature at which no destruction of the sample occurred. As a result, it was proved that, in core/shell grains which have a different composition between the interior and the surface, and grains in which a high iodide (or low iodide) layer is localized in the surface region, the value measured at room temperature is quite different from the true composition, due to decomposition of silver halide and diffusion of the halide (particularly, of the iodide).

The procedure of the XPS method employed in the invention is as follows. To an emulsion is added a 0.05% by weight proteinase aqueous solution and stirred at 45° C. for 30 min. to degrade the gelatin. After centrifuging and sedimenting the emulsion grains, the supernatant is removed. Then, distilled water is added thereto and the grains are redispersed. The resulting solution is coated on the mirror-finished surface of a silicon wafer to prepare a sample. Using the thus prepared sample, measurement of the surface iodide was conducted using the XPS method. In order to prevent sample destruction due to X-ray irradiation, the sample in the measuring chamber was cooled to −110 to −120° C., exposed to X-rays of Mg-Kα line generated at an X-ray source voltage of 15 kV and an X-ray source current of 40 mA and measured with respect to Ag3d5/2, Br3d and I3d3/2 electrons. From the integrated intensity of a measured peak which has been corrected with a sensitivity factor, the halide composition of the surface can be determined. In the invention, the interior of the grain is referred to as an internal region within the grain at a depth of 50 Å or more from the outermost surface.

The dislocation lines in tabular grains can be directly observed by means of transmission electron microscopy at a low temperature, for example, in accordance with methods described in J. F. Hamilton, *Phot. Sci. Eng.* 11 (1967) 57 and T. Shiozawa, *Journal of the Society of Photographic Science and Technology of Japan,* 35 (1972) 213. Silver halide tabular grains are taken out from an emulsion while ensuring to not exert any pressure to cause dislocation in the grains, and are placed on a mesh for electron microscopy. The sample is observed via transmission electron microscopy, while cooled to prevent the grain from being damaged (e.g., printing-out) by the electron beams. Since electron beam penetration is hampered as the grain thickness increases, sharper observation is obtained when using an electron microscope of a higher voltage (over 200 KV for 0.25 μm thick grains). From the thus-obtained electron micrograph, the position and number of the dislocation lines in each grain viewed perpendicularly to the major faces of the grain can be determined.

The tabular grains according to the invention each have dislocation lines in the peripheral region of the grain. The peripheral region of the grain is an outer region other than the central region of the major face of the tabular grain and having a thickness equivalent to the tabular grain thickness. The central region of the major face of the tabular grain is a circular area having a radius corresponding to 80% of the radius of a circle having an area equivalent to the major face, having a center which is identical to the center of the major face and having a thickness corresponding to that of the circular area of the tabular grain. In this case, the center of the tabular grain is the center of gravity of the tabular grain, when viewed from the direction perpendiculr to the major face of the tabular grain.

The dislocation lines in the peripheral region is preferably 5 to 100 nm in length, and more preferably 20 to 60 nm. The dislocation line can be easily determined by the method described above. The length of dislocation lines is determined one by one per a grain. The variation coefficient of the dislocation line length (or distribution of the dislocation line) is preferably 20% or less, and more preferably 15% or less. In this case, the variation coefficient of the dislocation line length is defined as follows:

standard deviation of the dislocation line length/average dislocation line length×100(%).

The number of the dislocation lines per grain is preferably monodispersed among the grains. The number of the dislocation lines present in the grain can be measured in the following manner. Electronmicrophotographs are taken with varying the declining angle with respect to the incident electron beam, to confirm the dislocation lines in which the dislocation lines are counted. In cases where the dislocation lines are too close to accurately count the number thereof, a number of dislocation lines are considered to be present in the grain.

In the invention, grains having dislocation lines of 10 or more per grain preferably account for at least 50% of the grain projected area. More preferably, grains having dislocation lines of 20 or more per grain account for at least 60%, and still more preferably, grains having dislocation lines of 30 or more per grain account for at least 70% of the grain projected area.

Optimal control of the dislocation line length and the distribution of the length can be achieved by optimal combination of the dislocation-introducing position, based on total silver addition amount, pH, pAg, temperature, the introducing method and shell forming conditions after introducing the dislocation lines. The dislocation-introducing time is preferably 90% or less, based on the total silver amount to added, more preferably 80% or less, and still more preferably 70% or less. In other words, the dislocation lines are preferably introduced at the time or before 90% of the total silver amount is added, more preferably at the time or before 80% of the total silver amount is added, and still more preferably at the time or before 70% of the total silver amount is added. The pH is arbitrary, but is preferably in the range of 5.0 to 6.5. The pAg is optionally selected, but to introduce the dislocation lines selectively in the peripheral region, it is important to increase the pAg after adding, to the substrate grains, an iodide ion source for introducing the dislocation lines (e.g., fine silver iodide grains, or an iodide ion releasing agent). However, when the pAg is excessively increased, so-called Ostwald ripening proceeds concurrently with grain growth, resulting in deterioration in monodispersity of the tabular grains. Accordingly, when forming the peripheral region of the tabular grains at the stage of grain growth, the pAg is preferably 8 to 12, and more preferably 9.5 to 11. In cases where the iodide ion releasing agent is used as an iodide ion source, the dislocation lines can effectively be formed by increasingly adding the agent. The iodide ion releasing agent is preferably added in an amount of 0.5 mol or more, and more preferably 1 to 3 mol per mol of silver halide. The dislocation lines are introduced preferably at a temperature of 60° C. or less, more preferably at 50° C. or less, and still more preferably at 40° C. or less.

The introduction of the dislocation lines into the tabular grains can be performed at a prescribed position to form a dislocation as an origin of the dislocation lines, using any of the several well-known methods. Examples of the method for introducing the dislocation lines include addition of an iodide ion containing aqueous solution such as a potassium iodide aqueous solution and a silver salt aqueous solution by the double jet method, addition of an iodide ion solution alone, addition of a fine iodide-containing silver halide grain emulsion, and addition of an iodide ion releasing agent described in JP-A 6-11781. Of these, addition of a fine iodide-containing silver halide grain emulsion, and addition of an iodide ion releasing agent are preferred. Preferably employed as the iodide ion releasing agent are sodium p-iodoacetoamidobenzenesulfonate, 2-iodoethanol or 2-iodoacetoamide.

When adding the fine iodide-containing silver halide grain emulsion to introduce the dislocation lines, it is important to optimally select shelling conditions so as to match the annihilation rate of the fine grains. Thus, at the initial stage after adding fine iodide-containing grain emulsion to introduce the dislocation lines, the addition rate of silver salt and halide salts are optimally selected so as to match the disappearing speed of the fine grains, and after the fine grains are disappeared, the addition rate is selected so as to match the grain growth rate. It is particularly important to abruptly and discontinuously vary the addition rate to match the disappearing speed of the fine grains and the growth rate of the tabular grains. When growing the first shell before the fine grains disappear, the addition rate of a silver salt or a halide is preferably 0.2 to 1.0 mol/min. per mol od silver halide, and more preferably 0.4 to 0.8 mol/min. per mol of silver halide. When subsequently growing the second shell after the fine grains disappear, the addition rate of a silver salt or a halide is preferably 0.8 to 1.6 mol/min. per mol of silver halide, and more preferably 0.4 to 0.8 mol/min. per mol of silver halide.

The tabular grains according to the invention can be chemically sensitized according to the conventional method. Sulfur sensitization, selenium sensitization and a gold sensitization by use of gold or other noble metal compounds can be employed singly or in combination. The tabular grains can be spectrally sensitized to a wanted wavelength region by use of sensitizing dyes known in the art. The sensitizing dye can be employed singly or in combination thereof. There may be incorporated, with the sensitizing dye, a dye having no spectral sensitizing ability or a supersensitizer which does not substantially absorb visible light and enhances sensitization of the dye.

An antifoggant and stabilizer can be added into the tabular grain emulsion. An emulsion layer or other hydrophilic colloid layers can be hardened with hardeners. A plasticizer or a dispersion of a water-soluble or water-insoluble polymer (so-called latex) can be incorporated.

In a silver halide emulsion layer of a photographic material, a coupler can be employed. There can also be employed a competing coupler having an effect of color correction and a compound which, upon coupling reaction with an oxidation product of a developing agent, is capable of releasing a photographically useful fragment, such as a developing accelerator, a developing agent, a silver halide solvent, a toning agent, hardener, a fogging agent, a chemical sensitizer, a spectral sensitizer and a desensitizer.

A filter layer, anti-halation layer or anti-irradiation layer can be provided in the photographic material relating to the invention. In these layers and/or an emulsion layer, a dye which is leachable from a processed photographic material or bleachable during processing, can be incorporated. Furthermore, a matting agent, lubricant, image stabilizer, formalin scavenger, UV absorbent, brightening agent, surfactant, development accelerator or development retarder is also incorporated into the photographic material. Employed may be, as a support, polyethylene-laminated paper, polyethylene terephthalate film, baryta paper or cellulose triacetate film.

EXAMPLE

Embodiments of the present invention will be further explained, based on examples but the invention is not limited to these examples.

Example 1

Preparation of Inventive Emulsion EM-1

Nucleation Stage

The following reaction mother liquor (Gr-1) contained in a reaction vessel was maintained at 30° C. and adjusted to a pH of 1.96 with a 1N sulfuric acid aqueous solution, while stirring at a rotation speed of 400 r.p.m. with a stirring mixer apparatus described in JP-A 62-160128. Thereafter, solutions (S-1) and (H-1) are added by the double jet addition at a constant flow rate for a period of 1 min. to form nucleus grains.

(Gr-1)

Alkali-processed gelatin (average molecular weight of 100,000) 40.50 g

Potassium bromide 12.40 g

Distilled water to make 16.2 l (S-1)

Silver nitrate 862.5 g

Distilled water to make 4.06 l (H-1)

Potassium bromide 604.5 g

Distilled water to make 4.06 l

Ripening Stage

After completing the above nucleation stage, solution (G-1) was added thereto and the temperature was raised to 60° C. in 30 min., while the silver potential of the emulsion within the reaction vessel (which was measured with a silver ion selection electrode using a saturated silver-silver chloride electrode, as a reference electrode) was controlled at 6 mV. Subsequently, the pH was adjusted to 9.3 with an aqueous ammonia solution and after maintained for 7 min., the pH was adjusted to 6.1 with an acetic acid aqueous solution, while the silver potential was maintained at 6 mV.

(G-1)

| | |
|---|---|
| Alkali-processed gelatin (average molecular weight of 100,000) | 173.9 g |
| $HO(CH_2CH_2O)_m(\overset{CH_3}{\overset{\vert}{C}}HCH_2O)_{19.8}(CH_2CH_2O)_nH$ (m + n = 9.77) (10% methanol solution) | 5.80 ml |
| Distilled water to make | 4.22 l |

Growth Stage

After completing the ripening stage, solutions (S-1) and (H-1) described above were added by the double jet addition at an accelerated flow rate (12 times faster at the end than at the start) for a period of 37 min. After completing addition, solution (G-2) was added and the stirring speed was adjusted to 550 r.p.m., then, solutions (S-2) and (H-2) were added by the double jet addition at an accelerated flow rate (2 times faster at the end than at the start) for a period of 40 min., while the silver potential of the emulsion was maintained at 6 mV. After completing addition, the temperature of the reaction mixture was lowered to 40° C. in 15 min., then, the silver potential was adjusted to −39 mV with a 3N potassium bromide aqueous solution. Subsequently, after adding solution (F-1) of 407.5 g, solutions (S-2) and (H-3) were added by the double jet addition for a period of 25 min, at an accelerated flow rate, provided that as shown in Table 1, when completing the first shell growth matching disappearance of fine grains, the flow rate was abruptly and discontinuously varied and then the second shell growth was performed.

(S-2)

Silver nitrate 2.10 kg

Distilled water to make 3.53 l (H-2)

Potassium bromide 859.5 g

Potassium iodide 24.45 g

Distilled water to make 2.11 l (H-3)

Potassium bromide 587.0 g

Potassium iodide 8.19 g

Distilled water to make 1.42 l (G-2)

| | |
|---|---|
| Ossein gelatin | 284.9 g |
| $HO(CH_2CH_2O)_m(\overset{CH_3}{\overset{\vert}{C}}HCH_2O)_{19.8}(CH_2CH_2O)_nH$ (m + n = 9.77) (10% methanol solution) | 7.75 ml |
| Distilled water to make | 1.93 l |

(F-1)

Fine grain emulsion comprised of 3 wt % gelatin and silver iodide grains (av. size of 0.05 μm) 407.5 g The above emulsion was prepared in the following manner. To 5000 ml of a 6.0 wt. % gelatin solution containing 0.06 mol of potassium iodide, an aqueous solution containing 7.06 mol of silver nitrate and an aqueous solution containing 7.06 mol of potassium iodide, 2000 ml of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight of the emulsion was 12.53 kg.

After completing grain growth, the emulsion was desalted according to the method described in JP-A 5-72658. Then, gelatin was further added thereto to redisperse the emulsion and the pH and pAg were adjusted to 5.80 and 8.06, respectively. The resulting emulsion was denoted as EM-1.

As a result of electronmicroscopic observation, it was proved that the resulting emulsion was comprised of tabular grains having an average diameter of 1.50 μm (average of equivalent circle diameter), a variation coefficient of grain diameter distribution of 15.0%, and an aspect ratio of 7.4 at 50% of the total grain projected area (i.e., 50% of the total grain projected area being accounted for tabular grains having an aspect ratio of 7.4 or more).

Preparation of Inventive Emulsion EM-2

Emulsion EM-2 was prepared in the same manner as in emulsion EM-1, except that the growth stage was varied as follows.

Growth Stage

After completing the ripening stage, solutions (S-1) and (H-1) described above were added by the double jet addition at an accelerated flow rate (12 times faster at the end than at the start) for a period of 37 min. After completing addition, solution (G-2) was added and the stirring speed was adjusted to 550 r.p.m., then, solutions (S-2) and (H-2) were added by the double jet addition at an accelerated flow rate (2 times faster at the end than at the start) for a period of 40 min., while the silver potential of the emulsion was maintained at 6 mV. After completing addition, the temperature of the reaction mixture was lowered to 40° C. in 15 min. Thereafter, solution (Z-1) and then solution (SS) were added, the pH was adjusted to 9.3 with an aqueous potassium hydroxide solution, and iodide ions were released while ripening for 4 min. Then, the pH was adjusted to 5.0 with an aqueous acetic acid solution and after the silver potential of the reaction mixture was −39 mV with a 3N potassium bromide solution, solutions (S-2) and (H-3) were added, for a period of 25 min, at an accelerated flow rate (i.e., faster at the end than at the start, and the flow rate was continuously varied, as shown in Table 1).

(S-2)
Silver nitrate 2.10 kg
Distilled water to make 3.53 l
(H-2)
Potassium bromide 859.5 g
Potassium iodide 24.45 g
Distilled water to make 2.11 l
(H-3)
Potassium bromide 587.0 g
Potassium iodide 8.19 g
Distilled water to make 1.42 l
(G-2)
Ossein gelatin 284.9 g

| | |
|---|---|
| $HO(CH_2CH_2O)_m(CH(CH_3)CH_2O)_{19.8}(CH_2CH_2O)_nH$ (m + n = 9.77) (10% methanol solution) | 7.75 ml |
| Distilled water to make | 1.93 l |
| (Z-1) | |
| Sodium p-acetoamidobenzenesulfonate | 83.4 g |
| Distilled water to make | 1.00 l |
| (SS) | |
| Sodium sulfite | 29.0 g |
| Distilled water to make | 0.30 l |

After completing grain growth, the emulsion was desalted according to the method described in JP-A 5-72658. Then, gelatin was further added thereto to redisperse the emulsion and the pH and pAg were adjusted to 5.80 and 8.06, respectively. The resulting emulsion was denoted as EM-2.

As a result of electronmicroscopic observation, it was proved that the resulting emulsion was comprised of tabular grains having an average diameter of 1.51 μm (average of equivalent circle diameter), a variation coefficient of grain diameter distribution of 14.5%, and an aspect ratio of 7.2 at 50% of the total grain projected area (i.e., 50% of the total grain projected area being accounted for tabular grains having an aspect ratio of 7.2 or more).

Preparation of Inventive Emulsion EM-3

Emulsion EM-3 was prepared in the same manner as in emulsion EM-1, except that in addition of solution (S-2) to form the host grain portion at the growth stage, the silver amount to be added was varied.

As a result of electronmicroscopic observation, it was proved that the resulting emulsion was comprised of tabular grains having an average diameter of 1.50 μm (average of equivalent circle diameter), a variation coefficient of grain diameter distribution of 20.0%, and an aspect ratio of 6.5 at 50% of the total grain projected area (i.e., 50% of the total grain projected area being accounted for tabular grains having an aspect ratio of 7.4 or more).

Preparation of Comparative Emulsion EM-4

Emulsion EM-4 was prepared in the same manner as in emulsion EM-1, except that at the growth stage, solutions (S-2) and (H-3) were added at an accelerated flow rate (faster at the end than at the start, and the flow rate was continuously varied, as shown in Table 1).

As a result of electronmicroscopic observation, it was proved that the resulting emulsion was comprised of tabular grains having an average diameter of 1.50 μm (average of equivalent circle diameter), a variation coefficient of grain diameter distribution of 25.0%, and an aspect ratio of 7.3 at 50% of the total grain projected area (i.e., 50% of the total grain projected area being accounted for tabular grains having an aspect ratio of 7.3 or more).

Preparation of Comparative Emulsion EM-5

Emulsion EM-4 was prepared in the same manner as in emulsion EM-3, except that at the growth stage, solutions (S-2) and (H-3) were added at an accelerated flow rate (faster at the end than at the start, and the flow rate was continuously varied, as shown in Table 1).

As a result of electronmicroscopic observation, it was proved that the resulting emulsion was comprised of tabular grains having an average diameter of 1.49 μm (average of equivalent circle diameter), a variation coefficient of grain diameter distribution of 32.0%, and an aspect ratio of 6.4 at 50% of the total grain projected area (i.e., 50% of the total grain projected area being accounted for tabular grains having an aspect ratio of 6.4 or more).

Preparation of Inventive Emulsion EM-6

Emulsion EM-6 was prepared in a manner similar to emulsion EM-1, provided that the amounts of solutions (Gr-1), (S-1) and (H-1) wee varied. As a result of electronmicroscopic observation, it was proved that the resulting emulsion was comprised of tabular grains having an average diameter of 0.66 μm (average of equivalent circle diameter), a variation coefficient of grain diameter distribution of 18.0%, and an aspect ratio of 3.2 at 50% of the total grain projected area (i.e., 50% of the total grain projected area being accounted for tabular grains having an aspect ratio of 3.2 or more).

Characteristics of each emulsion are summarized in Table 1.

TABLE 1

| Emulsion | Average grain diameter (μm) | Varaiation coef. of grain diameter (%) | Aspect ratio | Flow rate (mol/min) Discontinuous shelling 1st shell | Discontinuous shelling 2nd shell | Continuous shelling | Dislocation lines per grain/ percentage by number | Dislocation line length (nm) | Distribution of dislocation line length (%) | Remark |
|---|---|---|---|---|---|---|---|---|---|---|
| EM-1 | 1.50 | 15.0 | 7.4 | 0.3–0.5 | 1.2–1.3 | — | 30 lines/65%*1 | 40 | 20 | Inv. |
| EM-2 | 1.51 | 14.5 | 7.2 | — | — | 0.9–1.2 | 30 lines/80% | 45 | 13 | Inv. |
| EM-3 | 1.50 | 20.0 | 6.5 | 0.3–0.5 | 1.0–1.1 | — | 10 lines/50% | 100 | 20 | Inv. |
| EM-4 | 1.50 | 25.0 | 7.3 | — | — | 1.0–1.2 | 30 lines/70% | 40 | 30 | Comp. |
| EM-5 | 1.49 | 20.0 | 6.4 | — | — | 0.9–1.1 | 30 lines/65% | 120 | 30 | Comp. |

TABLE 1-continued

| Emulsion | Average grain diameter (μm) | Varaiation coef. of grain diameter (%) | Aspect ratio | Flow rate (mol/min) Discontinuous shelling 1st shell | Discontinuous shelling 2nd shell | Continuous shelling | Dislocation lines per grain/ percentage by number | Dislocation line length (nm) | Distribution of dislocation line length (%) | Remark |
|---|---|---|---|---|---|---|---|---|---|---|
| EM-6 | 0.66 | 18.0 | 3.2 | 0.6–0.7 | 1.4–1.5 | — | 30 lines/65% | 27 | 20 | Inv. |

*[1]grains having 30 or more dislocation lines account for 65% of total grain projected area

EXAMPLE 2

Preparation of photographic material

Emulsions EM-1 through EM-6 were each subjected to gold-sulfur sensitization and using these emulsions, the following layers having the composition described below were coated on a cellulose triacetate film support in this order from the support to prepare a multi-layered color photographic material.

A color photographic material 101 was as shown below, wherein the addition amount was expressed in g per $m^2$, unless otherwise noted. The coating amount of silver halide or colloidal silver was converted to silver. With respect to a sensitizing dye, it was expressed in mol per mol of silver halide contained in the same layer.

1st Layer; Antihalation Layer
Black colloidal silver 0.16
UV absorbent (UV-1) 0.20
High boiling solvent (OIL-1) 0.16
Gelatin 1.60
2nd Layer; Interlayer
Compound (SC-1) 0.14
High boiling solvent (OIL-2) 0.17
Gelatin 0.80
3rd layer; Low speed red-sensitive layer
Silver iodobromide emulsion A 0.15
Silver iodobromide emulsion B 0.35
Sensitizing dye (SD-1) $2.0\times10^{-4}$
Sensitizing dye (SD-2) $1.4\times10^{-4}$
Sensitizing dye (SD-3) $1.4\times10^{-5}$
Sensitizing dye (SD-4) $0.7\times10^{-4}$
Cyan coupler (C-1) 0.53
Colored cyan coupler (CC-1) 0.04
DIR compound (D-1) 0.025
High boiling solvent (OIL-3) 0.48
Gelatin 1.09
4th Layer; Medium Speed Red-sensitive Layer
Silver iodobromide emulsion B 0.30
Silver iodobromide emulsion C 0.34
Sensitizing dye (SD-1) $1.7\times10^{-4}$
Sensitizing dye (SD-2) $0.86\times10^{-4}$
Sensitizing dye (SD-3) $1.15\times10^{-5}$
Sensitizing dye (SD-4) $0.86\times10^{-4}$
Cyan coupler (C-1) 0.33
Colored cyan coupler (CC-1) 0.013
DIR compound (D-1) 0.02
High boiling solvent (OIL-1) 0.16
Gelatin 0.79
5th Layer; High Speed Red-sensitive Layer
Silver iodobromide emulsion D 0.95
Sensitizing dye (SD-1) $1.0\times10^{-4}$
Sensitizing dye (SD-2) $1.0\times10^{-4}$
Sensitizing dye (SD-3) $1.2\times10^{-5}$
Cyan coupler (C-2) 0.14
Colored cyan coupler (CC-1) 0.016
High boiling solvent (OIL-1) 0.16
Gelatin 0.79
6th Layer; Interlayer
Compound (SC-1) 0.09
High boiling solvent (OIL-2) 0.11
Gelatin 0.80
7th Layer; Low Speed Green-sensitive Layer
Silver iodobromide emulsion A 0.12
Silver iodobromide emulsion B 0.38
Sensitizing dye (SD-4) $4.6\times10^{-5}$
Sensitizing dye (SD-5) $4.1\times10^{-4}$
Magenta coupler (M-1) 0.14
Magenta coupler (M-2) 0.14
Colored magenta coupler (CM-1) 0.06
High boiling solvent (OIL-4) 0.34
Gelatin 0.70
8th Layer; Interlayer
Gelatin 0.41
9th Layer; Medium Speed Green-sensitive Layer
Silver iodobromide emulsion B 0.30
Silver iodobromide emulsion C 0.34
Sensitizing dye (SD-6) $1.2\times10^{-4}$
Sensitizing dye (SD-7) $1.2\times10^{-4}$
Sensitizing dye (SD-8) $1.2\times10^{-4}$
Magenta coupler (M-1) 0.04
Magenta coupler (M-2) 0.04
Colored magenta coupler (CM-1) 0.017
DIR compound (D-2) 0.025
DIR compound (D-3) 0.002
High boiling solvent (OIL-5) 0.12
Gelatin 0.50
10th Layer; High Speed Green-sensitive Layer
Silver iodobromide emulsion EM-0.95
Sensitizing dye (SD-6) $7.1\times10^{-5}$
Sensitizing dye (SD-7) $7.1\times10^{-5}$
Sensitizing dye (SD-8) $7.1\times10^{-5}$
Magenta coupler (M-1) 0.09
Colored magenta coupler (CM-2) 0.011
High boiling solvent (OIL-4) 0.11
Gelatin 0.79

11th Layer; Yellow Filter Layer

Yellow colloidal silver 0.08

Compound (SC-1) 0.15

High boiling solvent (OIL-2) 0.19

Gelatin 1.10

12th Layer; Low Speed Blue-sensitive Layer

Silver iodobromide emulsion A 0.12

Silver iodobromide emulsion B 0.24

Silver iodobromide emulsion C 0.12

Sensitizing dye (SD-9) $6.3\times10^{-5}$

Sensitizing dye (SD-10) $1.0\times10^{-5}$

Yellow coupler (Y-1) 0.50

Yellow coupler (Y-2) 0.50

DIR compound (D-4) 0.04

DIR compound (D-5) 0.02

High boiling solvent (OIL-2) 0.42

Gelatin 1.40

13th Layer; High Speed Blue-sensitive Layer

Silver iodobromide emulsion C 0.15

Silver iodobromide emulsion E 0.80

Sensitizing dye (SD-9) $8.0\times10^{-5}$

Sensitizing dye (SD-11) $3.1\times10^{-5}$

Yellow coupler (Y-1) 0.12

High boiling solvent (OIL-2) 0.05

Gelatin 0.79

14th Layer; First Protective Layer

Silver iodobromide emulsion (Av. grain size of 0.08 μm, 1 mol % iodide) 0.40

UV absorbent (UV-1) 0.065

High boiling solvent (OIL-1) 0.07

High boiling solvent (OIL-3) 0.07

Gelatin 0.65

15th Layer; Second Protective Layer

Alkali-soluble matting agent (PM-1, Av. 2 μm) 0.15

Polymethylmethacrylate (Av. 3 μm) 0.04

Slipping agent (WAX-1) 0.04

Gelatin 0.55

In addition to the above composition were added coating aids (SU-1 and 2), viscosity-adjusting agent (V-1), Hardener (H-1 and 2), stabilizer (ST-1), fog restrainer (AF-1), dye (AI-1 and 2), AF-2 comprising two kinds of weight-averaged molecular weights of 10,000 and 1.100,000 and antimold (DI-1).

Emulsions used in the above sample are as follows, in which an average grain size is represented as calculated in terms of a cubic grain. Each of the emulsions was optimally subjected to gold-sulfur sensitization.

TABLE 2

| Emulsion | Av. AgI content (mol %) | Av. grain diameter (μm) | Crystal habit | Diameter/thickness ratio | Remark |
|---|---|---|---|---|---|
| A | 4.0 | 0.30 | Regular* | 1 | |
| B | 6.0 | 0.42 | Regular | 1 | |
| C | 6.0 | 0.55 | Regular | 1 | |
| D | 6.0 | 0.85 | Twinned tabular* | 4 | |
| E | 6.0 | 0.95 | Twinned tabular | 4 | |
| F | 8.0 | 0.95 | Twinned tabular | 4 | Pb, Iodide |
| G | 8.0 | 0.95 | Twinned tabular | 4 | In, iodide |
| H | 8.0 | 0.95 | Twinned tabular | 4 | Fe, iodide |
| I | 8.0 | 0.95 | Twinned tabular | 4 | Pb, In, iodide |
| J | 8.0 | 0.95 | Twinned tabular | 4 | Pb, Dislocation, iodide |
| K | 8.0 | 0.95 | Twinned tabular | 4 | Pb, PTTS |
| L | 4.0 | 0.55 | Regular | 1 | Pb, iodide |
| M | 4.0 | 0.55 | Regular | 1 | In, iodide |

*Regular: Regular crystal

Twinned tabular: Twinned tabular crstal

In the Table, emulsions F through M each contains a metal shown in the column "Remarks" in an amount of $1\times10^{-5}$ mol/mol Ag, and iodide or PTS (p-toluenethiosulfonic acid) was added during grain formation.

In the sample, the 1st layer to 8th layer were simultaneously coated, and then the 9th layer to 15th layer were simultaneously coated. The silver coating weight and dry layer thickness of Sample 101 were 6.25 g/m$^2$ and 18 μm, respectively.

C-1

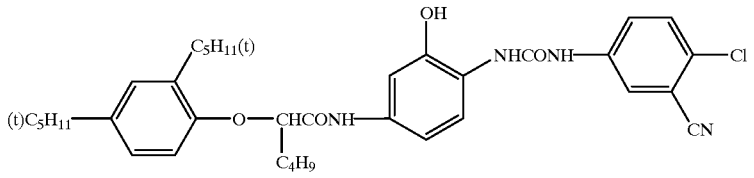

5
-continued
C-2
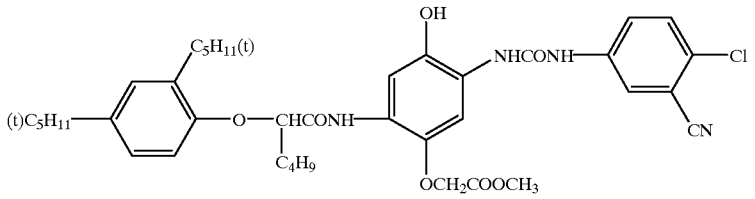
M-1
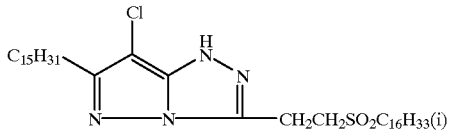
M-2
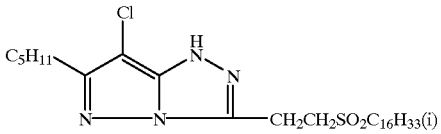
M-3
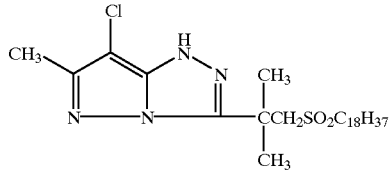
M-4
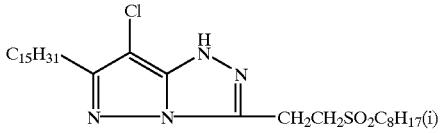
M-5
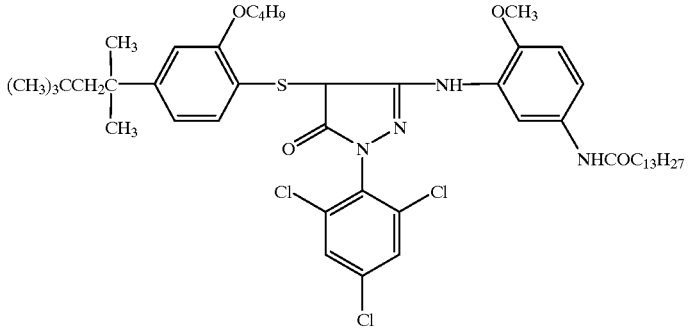
Y-1
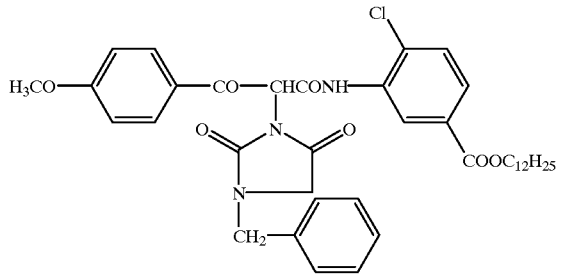
Y-2
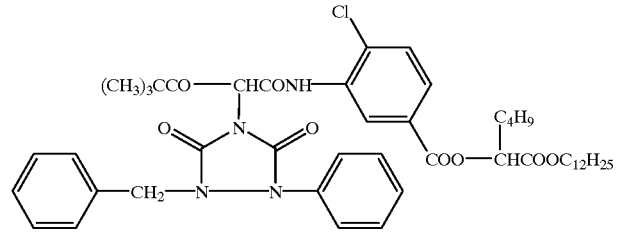
CC-1
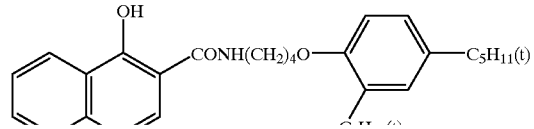

Samples 102 through 105 were each prepared in the same manner as Sample 101, except that EM-1 was replaced by EM-2, 3, 4 or 5. Furthermore, Sample 106 was prepared in the same manner as Sample 102, except that silver iodobromide emulsions A and B used in the 7th layer (low-speed green-sensitive layer) were replaced by emulsion EM-6.

The thus prepared samples each were exposed to green light (G) through a sensitometry wedge (1/200"), processed according to the following process and evaluated with respect to relative sensitivity, graininess and characteristics pressure and high intensity reciprocity law failure.

Processing steps are as follows:

Process

| | | |
|---|---|---|
| 1. Color developing | 3 min. 15 sec. | 38.0 ± 0.1° C. |
| 2. Bleach | 6 min. 30 sec. | 38.0 ± 3.0° C. |
| 3. Washing | 3 min. 15 sec. | 24–41° C. |
| 4. Fixing | 6 min. 30 sec. | 38.0 ± 3.0° C. |
| 5. Washing | 3 min. 15 sec. | 24–41° C. |
| 6. Stabilizing | 3 min. 15 sec. | 38.0 ± 3.0° C. |
| 7. Drying | | 50° C. or less |

Composition of a processing solution used in each step is as follows.

Color developing solution

4-Amino-3-methyl-N-ethyl-N-(β-hydroxy ethyl)aniline sulfate 4.75 g

Sodium sulfite anhydride 4.25 g

Hydroxylamine ½ sulfate 2.0 g

Potassium carbonate anhydride 37.5 g

Sodium bromide 1.3 g

Trisodium nitrilotriacetate (monohydrate) 2.5 g

Potassium hydroxide 1.0 g

Water to make 1 liter

The pH was adjusted to 10.1.

Bleaching solution

Ammonium ferric ethylenediaminetetraacetate 100.0 g

Diammonium ethylenediaminetetraacetate 10.0 g

Ammonium bromide 150 0 g

Glacial acetic acid 10.0 g

Water to make 1 liter

The pH was adjusted to 6.0 using ammonia water.

Fixing solution

Ammonium thiosulfate 175.0 g

Sodium sulfite anhydride 8.5 g

Sodium metasulfite 2.3 g

Water to make 1 liter

The pH was adjusted to 6.0 with acetic acid.

Stabilizing solution

Formalin (37% aqueous solution) 1.5 cc

Koniducks (product by Konica Corp.) 7.5 cc

Water to make 1 liter

Results are summarized in Table 3.

TABLE 3

| Sample | Sensitivity | Graininess | ΔD1*1 | ΔD2*2 | H.I.R.F.*3 (%) | Remark |
|---|---|---|---|---|---|---|
| 101 | 100 | 100 | 100 | 100 | 100 | Inv. |
| 102 | 160 | 99 | 100 | 61 | 150 | Inv. |
| 103 | 98 | 102 | 102 | 98 | 99 | Inv. |
| 104 | 99 | 160 | 101 | 110 | 60 | Comp. |
| 105 | 101 | 120 | 98 | 171 | 54 | Comp. |
| 106 | 180 | 100 | 100 | 57 | 170 | Inv. |

*1Pressure fog

*2Pressure desensitization

*3High intensity reciprocity law failure

Sensitivity was shown as a relative value of reciprocal of exposure giving a magenta density of Dmin (minimum density) +0.15 based on that of Sample 101 being 100. The higher the value, higher the sensitivity.

Graininess was shown as a relative value of a standard deviation of density variation (RMS value) at a density of Dmin +0.50 which was measured with a microdensitometer having an aperture scanning area of 250 $\mu m^2$, based on that of Sample 101 being 100. The lower the RMS value, the better the graininess.

Pressure characteristic was evaluated as follows. After contacting with a needle having a 0.025 mm curvature radius of the point, loaded with 5 g and moving at a constant speed using a scratch tester (produced by Shinto Kagaku) at 23° C. and 55% RH, photographic material samples were each exposed and processed. The density variation, at a density of Dmin or Dmin +0.40, of the loaded portion, which were respectively denoted as ΔD1 (Dmin) and ΔD2 (Dmin +0.4), was measured. ΔD1 and ΔD2, which indicate a measure of pressure resistance, are represented as a relative value, based on that of Sample 101 being 100. The lower the value of ΔD1 or ΔD2, the better the pressure resistance.

High intensity reciprocity failure characteristic (HIRF) was evaluated as follows. After being subjected to exposure at 1/10000 sec. and 3.2 CMS, photographic material samples were similarly processed. The sensitivity of high intensity exposure was relatively evaluated, based on the sensitivity at exposure of 1/200 sec. of each sample being 100. The sensitivity of high intensity exposure was shown as relative value, based on the above-described relative sensitivity of Sample 101 being 100. The more the relative sensitivity, the more improved the high intensity reciprocity failure.

As can be seen from Table 3, it is proved that inventive Samples 101 to 103 and 106 containing the inventive emulsion exhibited higher sensitivity, superior graininess, and improved pressure resistance and high intensity reciprocity failure characteristics. Specifically, Sample 106, which was one of the best mode of the invention, exhibited excellent photographic performance.

What is claimed is:

1. A silver halide emulsion comprising silver halide grains, at least 50% of total grain projected area being accounted for by tabular silver halide grains having an aspect ratio of 2 or more and further having a variation coefficient of grain diameter of 20% or less, said tabular grains each having 10 or more dislocation lines per grain in the peripheral region of the grain and having a variation coefficient of dislocation line length of 20% or less.

2. The silver halide emulsion of claim 1, wherein the dislocation lines in the peripheral region of the grain are 30 or more per grain.

3. The silver halide emulsion of claim 1, wherein said dislocation lines are 5 to 100 nm in length.

4. A silver halide light sensitive color photographic material comprising a support having thereon a light sensitive layer containing a silver halide emulsion and a dye-forming coupler, wherein said silver halide emulsion comprises silver halide grains, at least 50% of total grain projected area being accounted for by tabular grains having an aspect ratio of 2 or more and further having a variation coefficient of a grain diameter of 20% or less, said tabular grains each having 10. or more dislocation lines in the peripheral region of the grain and a variation coefficient of a dislocation line length of 20% or less.

5. The color photographic material of claim 4, wherein the dislocation lines in the peripheral region are 30 or more per grain.

6. The color photographic material of claim 4, wherein the length of the dislocation lines is 5 to 100 nm.

* * * * *